US006080005A

United States Patent [19]

Aoyama et al.

[11] Patent Number: 6,080,005

[45] Date of Patent: Jun. 27, 2000

[54] TERMINAL FITTING

[75] Inventors: Masahiko Aoyama; Hitoshi Okumura; Mitsugu Furutani; Keigo Atsumi, all of Yokkaichi, Japan

[73] Assignee: Sumitomo Wiring Systems, Ltd., Japan

[21] Appl. No.: 08/984,642

[22] Filed: Dec. 3, 1997

[30] Foreign Application Priority Data

Dec. 3, 1996 [JP] Japan ..... 8-322684

[51] Int. Cl.[7] ..... H01R 11/20

[52] U.S. Cl. ..... 439/397; 439/406

[58] Field of Search ..... 439/387, 391, 439/393, 395, 397, 398, 406

[56] References Cited

U.S. PATENT DOCUMENTS

| | | | |
|---|---|---|---|
| 4,035,049 | 7/1977 | McKee . | |
| 5,030,143 | 7/1991 | Hatagishi | 439/861 |
| 5,133,672 | 7/1992 | Nelligan, Jr. et al. . | |
| 5,139,434 | 8/1992 | Goodman . | |
| 5,380,218 | 1/1995 | Yamamoto et al. | 439/397 |
| 5,399,097 | 3/1995 | Sakai et al. . | |
| 5,588,868 | 12/1996 | Tsuji et al. . | |
| 5,591,044 | 1/1997 | Abe et al. . | |

FOREIGN PATENT DOCUMENTS

| | | |
|---|---|---|
| 2721758 | 12/1995 | France . |
| 60-68568 | 4/1985 | Japan . |
| 6-168743 | 6/1994 | Japan . |
| 2004425 | 3/1979 | United Kingdom . |

*Primary Examiner*—Lincoln Donovan
*Attorney, Agent, or Firm*—Banner & Witcoff, Ltd.

[57] ABSTRACT

A pressure contact electrical terminal (20) is formed by bending inwards upper ends of left and right side walls (21), a pair of left and right pressure contact blades (22) being provided anteriorly and posteriorly, and connected by means of a connecting arm (23). In this manner, when an external tensile force is applied to an electric wire W, a change in shape of the pressure contact blades (22) in the direction of the pulling force is avoided.

10 Claims, 5 Drawing Sheets

TERMINAL FITTING

TECHNICAL FIELD

The present invention relates to a so-called pressure contact type electrical terminal fitting.

BACKGROUND TO THE INVENTION

FIG. 10 of this specification shows a common pressure contact type terminal fitting having a pressure contact member for making contact with a core of a covered electric wire W, and barrel members 2 for crimping the electric wire W. The pressure contact member 1 has pairs of anterior and posterior pressure contact blades 3 formed by bending anterior and posterior ends of left and right side plates 5 inwards so as to face each other. When the electric wire W is pressed between the pressure contact blades 3, they cut through the covered portion of the electric wire W and make contact with the core thereof. The barrel members 2 are slightly displaced with respect to each other and by crimping them. The wire W is thereby fixed to the terminal fitting.

However, according to the above configuration, when, for example, the electric wire is pulled strongly, the tensile force is applied to the pressure contact blades. Since the pressure contact blades are formed by bending, this pulling force can cause them to bend back, and the electrical contact may be broken or become unreliable.

The present invention has been developed after taking the above problem into consideration, and aims to provide a terminal fitting wherein a change of shape of the pressure contact blades in the direction of the pulling force can be prevented.

SUMMARY OF THE INVENTION

According to the invention there is provided an electrical terminal fitting having upstanding side walls and for receiving a wire W along a longitudinal axis therebetween, the fitting being folded from sheet metal and having two pairs of mutually opposed blades spaced along said axis, each pair of blades defining a contact groove on said axis and being adapted to engage an electrical wire, wherein the adjacent blades on each side of said axis are connected by respective connecting members extending in the direction of said axis. Such a fitting can be bent from a sheet metal blank, the connecting members reinforcing the blades so as to resist a tensile force on a wire connected thereto.

Many configurations are possible. A connecting member may be integrally connected to each side wall and have two blades connected thereto.

Alternatively each blade of a pair of blades may be connected by a bridge, and the pairs of blades connected by respective connecting members, one of the connecting members being integrally connected to a side wall, and the other being free.

Additional mechanical support in the shape of protrusions and apertures may be provided to permit interengagement of a connecting member and blade, or a blade and side wall. Alternatively support for the blades may be provided by protrusions punched in or sheared from a respective side wall.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

A first embodiment of the present invention is explained hereinbelow, with reference to FIGS. 1 to 4.

Figure 4:
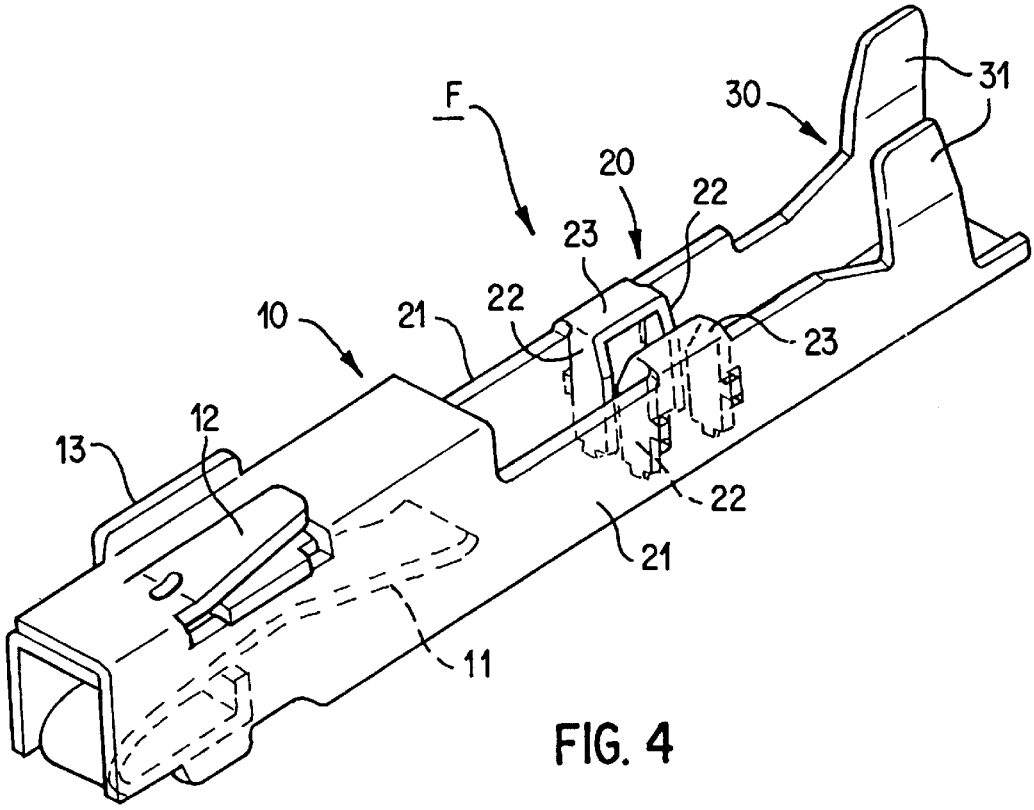
FIG. 4 is a diagonal view showing the entirety of a terminal fitting of the first embodiment.

A female terminal fitting F is configured by bending an electrically conductive metal plate. As shown in FIG. 4, the anterior portion (in FIG. 4, the left lower side) has a connecting portion 10 for inserting a corresponding terminal fitting (not shown), and its posterior end has a pressure contact member 20 for making pressure contact with a core of an electric wire W, and barrels 30 for clamping the covered portion of the electric wire W.

The connecting portion 10 has a box shape and its anterior face is open. In its interior, a resilient contact member 11 is formed by folding in an anterior edge thereof. The resilient contact member 11 makes contact with the corresponding terminal fitting. The upper face of the connecting portion 10 has a lance 12 that fits with a housing (not shown) and thereby makes the female terminal fitting F unremovable, and a stabilizer 13 that guides the insertion of the female terminal fitting F into the housing.

Figure 1:
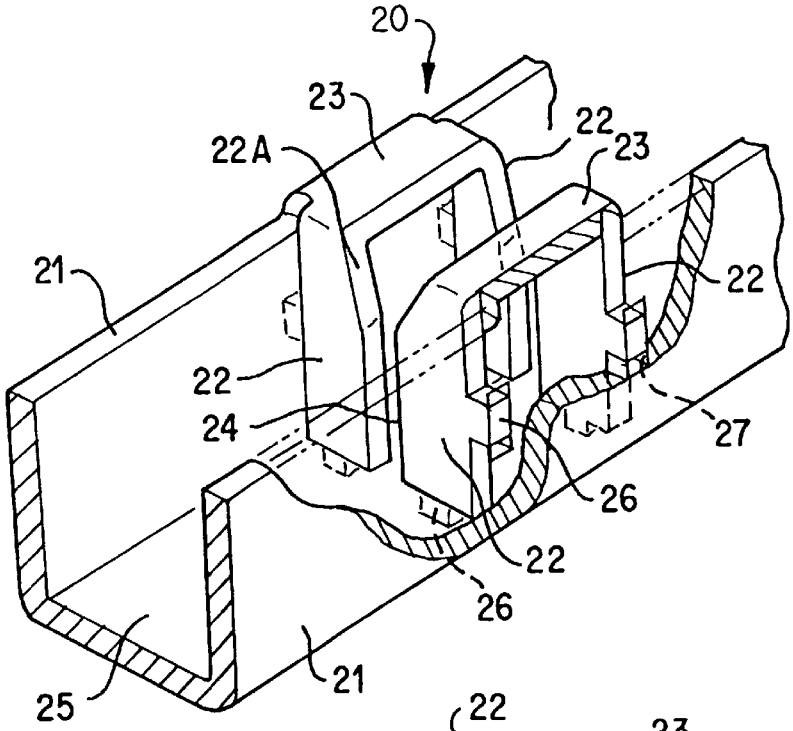
FIG. 1 is a partially cut-away diagonal view of a pressure contact member of a first embodiment.

A pressure contact member 20 is provided at the posterior end of the connecting portion 10, and, as shown in FIG. 1, portions of the upper edges of left and right side walls 21 are bent inwards so as to face each other, and anterior and posterior ends thereof are bent downwards. In this manner, a pair of anterior and posterior pressure contact blades 22 is formed to the left and right. The upper edges of the pressure contact blades 22 located anteriorly and posteriorly are connected by connecting arms 23. Pressure contact grooves 24 are formed between the facing edges of the left and right pressure contact blades 22. When the electric wire W is pressed therein, each pressure contact blade 22 cuts into the covering of the electric wire W and makes contact with the core.

Fitting protrusions 26 are formed on edges of the pressure contact blades 22, the edges fitting with the side walls 21 and on the base member 25. These fitting protrusions 26 fit into fitting holes 27 formed on the side walls 21 and the base member 25. The upper portions of the facing edges of the pressure contact blades 22 are cut away diagonally so as to form electric wire contact members 22A, which make the insertion of the electric wire W into the pressure contact grooves 24 easier.

Figure 2:
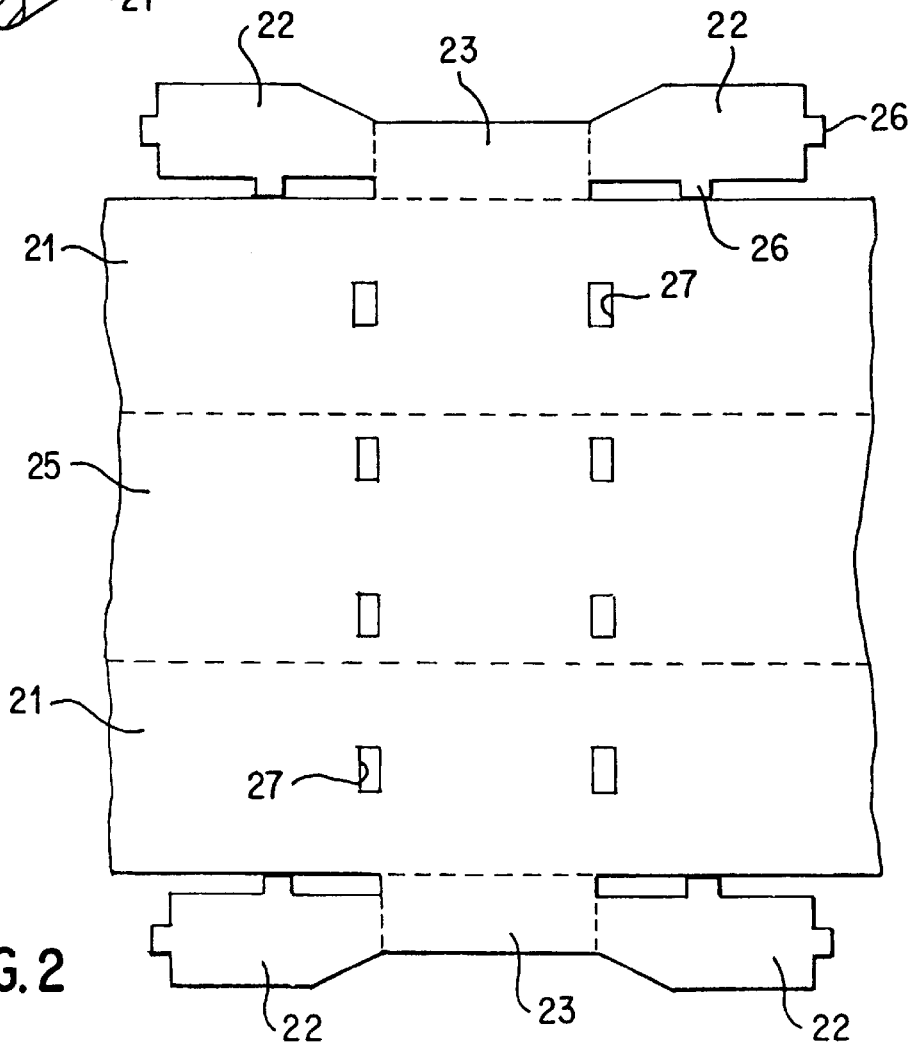
FIG. 2 is a developed view of the pressure contact member of the first embodiment.
Figure 3:
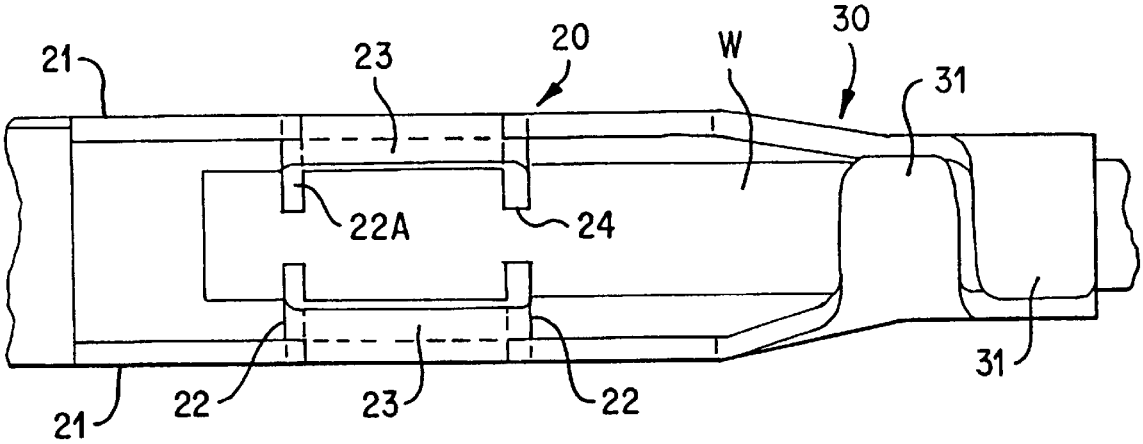
FIG. 3 is a view of the upper face of the pressure contact member of the first embodiment.

FIG. 2 shows a developed view of the pressure contact member 20. In the diagram, the number 25 constitutes the base member, its left and right edges (on the upper and lower sides on the diagram) having the left and right side walls 21 connected thereto. Further, the outer edges of the side walls 21 have the connecting arms 23 protruding symmetrically therefrom, the anterior and posterior edges of the connecting arms 23 (the left and right edges thereof in the diagram) having the pressure contact blades 22 symmetrically protruding therefrom. Furthermore, the edges of the pressure contact blades 22 have the fitting protrusions 26 formed thereon, the side walls 21 and the base plate 25 having the fitting holes 27 located anteriorly and posteriorly in two rows, into which the fitting protrusions 26 engage.

The barrels 30 have left and right barrel members 31 protruding upwards. By clamping these, the electric wire W can be fixed with the female terminal fitting F. Moreover, each barrel member 31 is located so as to be slightly displaced with respect to the other in the anterior-posterior direction, thereby achieving a state whereby the electric wire W is prevented from rising upwards by each of the barrel members 31. This ensures that the area of contact between the barrel member 31 and the electric wire W is the highest possible, so that even though the clamping force is small, the electric wire W is fixed with certainty.

Next, the assembly sequence of the pressure contact member 20 is described. In order to assemble the pressure contact member 20, the metal plate shown in FIG. 2 is bent in sequence along the broken lines shown in the diagram, as described below. First, the pressure contact blades 22 are bent upwards from the root portion of the connecting arm 23 and made to face each other anteriorly and posteriorly. After that, the connecting arms 23 are bent upwards so as to become approximately at a right angle with respect to the side walls 21. Then, one of the fitting protrusions 26 of each pressure contact blades 22 is inserted into a fitting hole 27 formed in the respective side wall 21.

Next, the left and right side walls 21 are bent upwards at a right angle with respect to the base member 25, and the remaining fitting protrusions 26 of each of the pressure contact blades 22 are inserted into the fitting holes 27 formed in the base member 25. In this manner, the assembly of the pressure contact member 20 is completed (see FIG. 1).

In order to connect the electric wire W to the female terminal fitting F of the present embodiment, first, one end of the electric wire W is placed so as to extend between the anterior and posterior pressure contact blades 22, and then it is inserted into the pressure contact grooves 24. In this way, the pressure contact blades 22 cut through the covering of the electric wire W and make contact with the core, thereby ensuring conductivity between the female terminal fitting F and the electric wire W. After this, the barrels 31 are crimped, and the connection operation of the electric wire W comes to an end (see FIG. 3).

If, for example, the extent of clamping of the barrels 31 with respect to the electric wire W is weak, in the case where the electric wire W is pulled, the tensile force applies on the pressure contact blades 22. However, since in the present embodiment the pressure contact blades 22 are connected anteriorly and posteriorly by means of the connecting arms 23, the pressure blades 22 do not change shape due to a pulling force from the electric wire W. Moreover, by providing the fitting protrusions 26 and the fitting holes 27, change of shape of the pressure contact blades 22 becomes even more difficult.

Since each pressure contact blade 22 is formed by further bending the connecting arm 23, the connecting arms 23 in turn being formed by bending the upper edges of the left and right side walls 21, the pressure contact blades 22 can be formed without opening the side walls 21 or the base member 25. As a result, a reduction in the strength of the side walls 21 is avoided.

Moreover, by connecting the pressure contact blades 22 with the connecting arm 23, each pressure contact blade 22 can be located so as to face the other at anterior and posterior locations. Accordingly, the accuracy of the distance between the anterior and posterior pressure contact blades 22 is improved.

Figure 5:
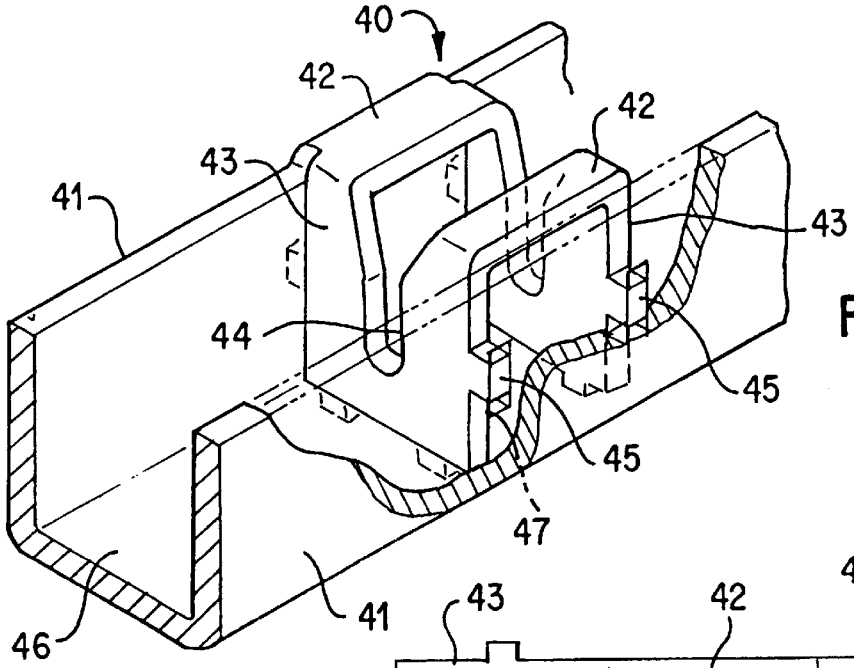
FIG. 5 is a partially cut-away diagonal view of a pressure contact member of the second embodiment.
Figure 6:
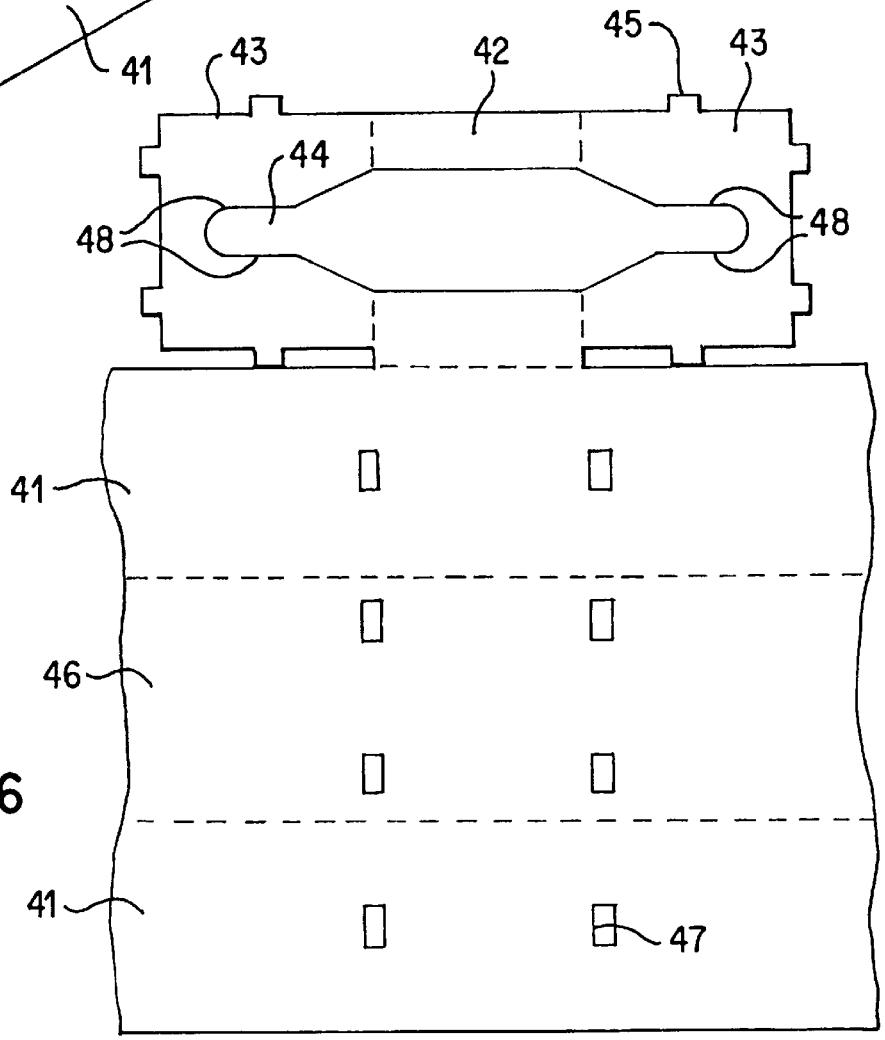
FIG. 6 is a developed view of the pressure contact member of the second embodiment.

A second embodiment of the present invention is explained with the aid of FIGS. 5 and 6. This embodiment differs from the first embodiment with respect to the configuration of a pressure contact member 40. Since the configuration of the other parts is the same as in the first embodiment, the same numbers are accorded to parts having the same configuration as in the first embodiment, and an explanation thereof omitted.

As shown in FIG. 5, the pressure contact member 40 comprises a connecting arm 42 bent from one of the side walls 41 (on the inner side in FIG. 5), and a pressure contact plate 43 that connects with the connecting arm 42. The connecting arm 42 is formed by bending the upper edge of the side wall 41 inwards at approximately a right angle, the pressure contact plates 43 being connected so as to face each other at anterior and posterior side edges (the left lower edge and the right upper edge in FIG. 5) of the connecting arms 42. Each pressure contact plate 43 has a pressure contact groove 44 pre-formed by means of a press-process, the pressure contact grooves 44 being connected via the connecting arm 42. When the electric wire W is inserted into the pressure contact grooves 44, the edges (blades) 48 of the pressure contact grooves 44 cut through the covering of the electric wire W and make contact with the core. Furthermore, in this pressure contact plate 43, the side portions to the left and right of the pressure contact grooves 44 form a pair of pressure contact blades relating to the present invention, these pressure contact blades being connected at their lower ends.

The left, right and lower edges of each pressure contact plate 43 have fitting protrusions 45 formed thereon, these fitting into fitting holes 47 formed on the left and right side walls 41 and the base member 46. The upper ends of the pressure contact grooves 44 widen in the upward direction, thereby making it easier for the electric wire W to be inserted into the pressure contact grooves 44.

FIG. 6 shows a developed view of the pressure contact member 40. The left and right sides of the base member 46 have the left and right side walls 41 connecting thereto, the outer edge of the left side wall 41 has the connecting arm 42 protruding therefrom. The anterior and posterior ends of the connecting arm 42 have the pressure contact plates 43 protruding therefrom. Both the pressure contact plates 43 have pressure contact grooves 44 formed therein, the pressure contact grooves 44 being connected via the connecting arm 42. Further, the outer edges of the pressure contact plates 43 have a total of four fitting protrusions 45, the fitting holes 47 that allow the fitting protrusions 45 to fit therein being formed on the base member 46 and the side walls 41.

In order to assemble the pressure contact member 40, the expanded pressure contact member 40 is bent along the broken lines shown in FIG. 6, in the sequence described below. First, the pressure contact plates 43 are bent upwards at a right angle with respect to the connecting arm 42. Then, the connecting arm 42 is bent upwards at a right angle with respect to the left side wall 41, and one of the fitting protrusions 45 of the pressure contact plate 43 is inserted into the fitting hole 47 formed in left side wall 41. After this, the left and right side walls 41 are bent at a right angle with respect to the base member 45, and the remaining fitting protrusions 45 of the pressure contact plates 43 are inserted into the fitting holes 47 of the base member 46 and the right side wall 41. With this, the assembly of the pressure contact member 40 is complete.

In the second embodiment, since the pressure contact grooves 44 are pre-formed by means of a press-process, the accuracy of dimension the pressure contact grooves 44 can be increased. Further, as in the first embodiment, since in the assembled state the upper edge of each pressure contact plate 43 (pressure contact blade) is connected, change of shape of the pressure contact plate 43 due to a pulling force of the electric wire W can be prevented. Moreover, as in the case of the first embodiment, apart from making change in shape of the pressure contact plates 43 difficult by means of the fitting protrusions 45 and the fitting holes 47, reduction in strength of the side wall 41 etc. can be avoided, and the accuracy of the dimension of the pressure contact plate 43 can be increased.

Figure 7:
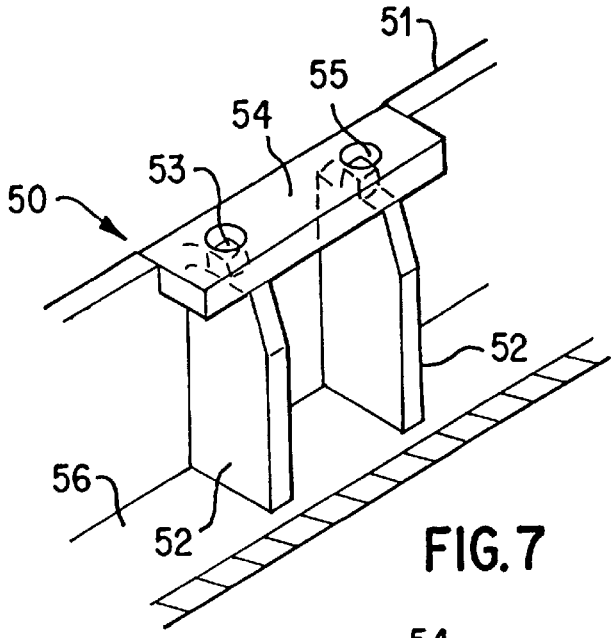
FIG. 7 is a partially cut-away diagonal view of the pressure contact member of the third embodiment.
Figure 8:
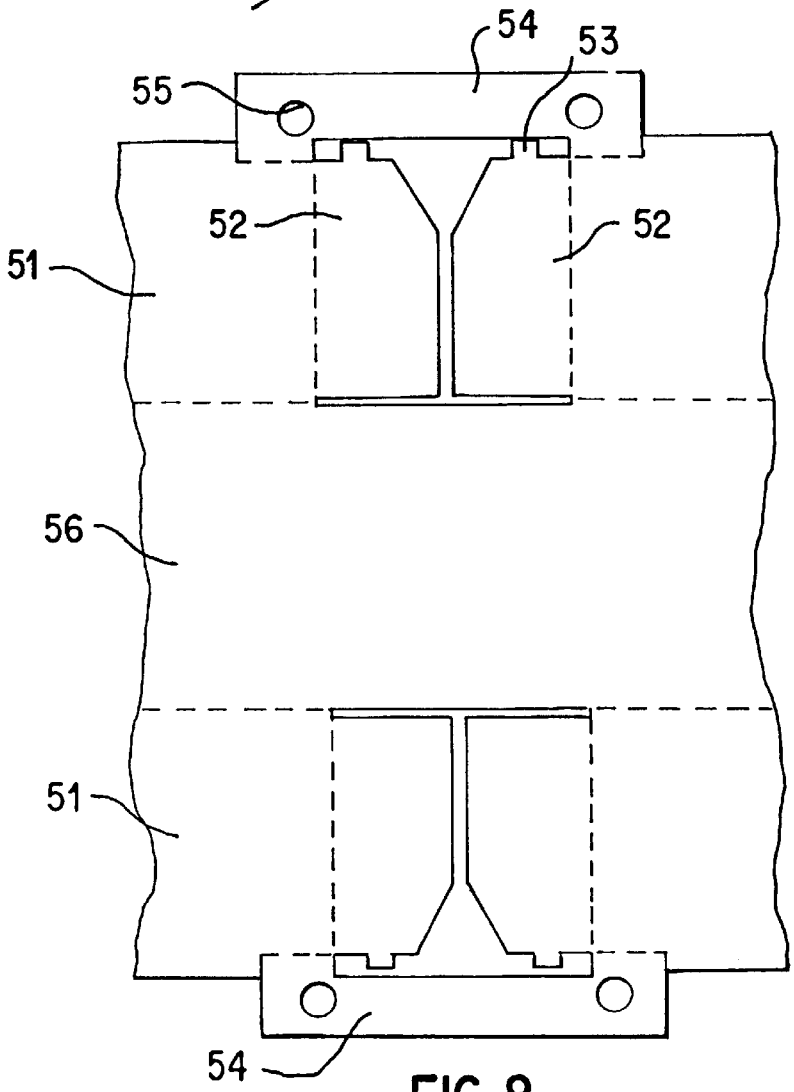
FIG. 8 is a developed view of the pressure contact member of the third embodiment.

A third embodiment of the present invention is explained with the aid of FIGS. 7 and 8.

The present embodiment differs from the first embodiment with respect to the configuration of a pressure contact member 50. Since the configuration of the other parts is the same as in the first embodiment, the same numbers are accorded to parts having the same configuration as in the first embodiment, and an explanation thereof omitted.

As shown in FIG. 7, in the present embodiment, pressure contact blades 52 are part-sheared inwards from left and right side walls 51. Accordingly, left and right side walls 51 have a pair of left and right pressure contact blades 52 formed anteriorly and posteriorly and facing each other. The upper edges of the pressure contact blades 52 have fitting protrusions 53 formed thereon. Further, connecting arms 54 are formed by bending inwards the upper edge of the left and right side walls 51. This connecting arm 54 has anterior and posterior fitting holes 55 formed thereon which allowing the fitting protrusions 53 to fit therein.

FIG. 8 is a developed view of the pressure contact member 50. In order to assemble the pressure contact member 50, the expanded pressure contact member 50 is bent along the broken lines shown in the diagram. First, the pressure contact blades 52 are bent upwards and each connecting arm 54 is bent upwards at a right angle. Then, each fitting protrusion 53 is inserted into a fitting hole 55. After that, the left and right side walls 51 are bent upwards at a right angle with respect to the base member 56. This completes the assembly of the pressure contact member 50.

In this manner, the upper edges of the pressure contact blades 52 are connected by means of the connecting arms 54. Accordingly, as in the first embodiment, change in shape of the pressure contact blades 52 due to a pulling force applied to the electric wire W can be prevented from occurring. Further, the accuracy of dimension between the anterior and posterior pressure contact blades 52 can be improved.

Figure 9:
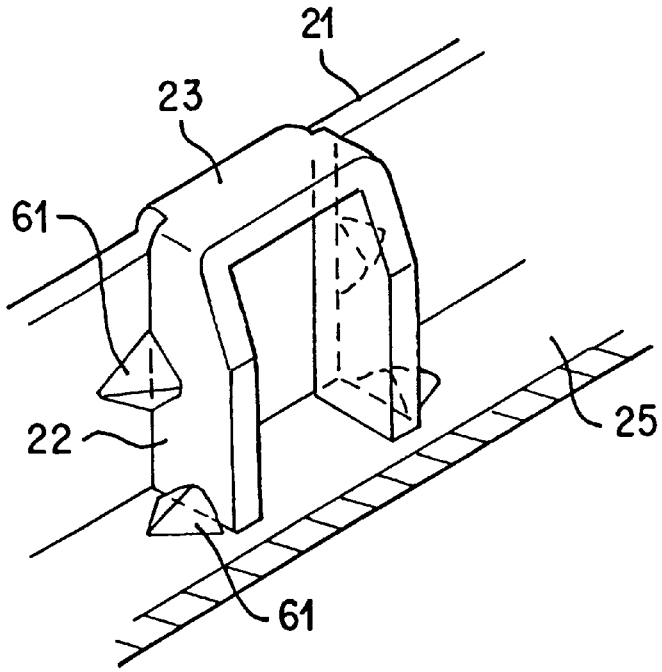
FIG. 9 is a partially cut-away diagonal view of the pressure contact member of the fourth embodiment.
Figure 10:
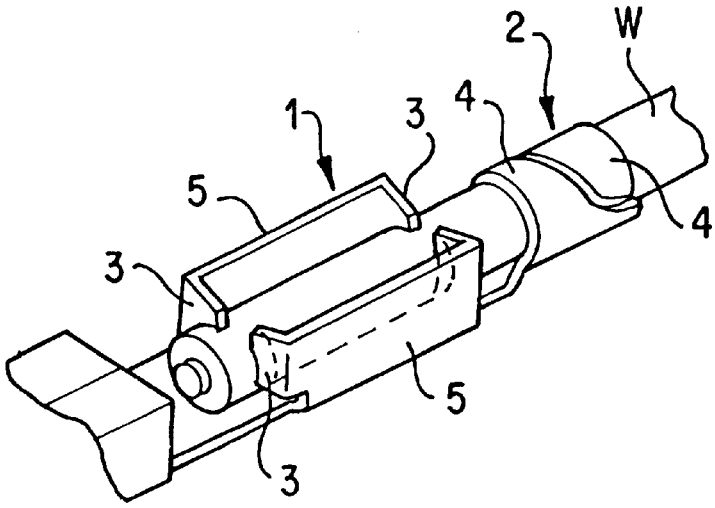
FIG. 10 PRIOR ART
FIG. 10 is a diagonal view of a pressure contact member of a conventional example.

A fourth embodiment of the present invention is explained with the aid of FIG. 9.

The present embodiment differs from the first embodiment in that protrusions 61 are knocked out from side walls 21 and a base member 25 along the external sides of contact blades 22. Since the configuration of the other parts is the same as in the first embodiment, the same are accorded to parts having the same configuration as in the first embodiment, and an explanation thereof omitted.

In this manner, not only are the pressure contact blades 22 connected by means of a connecting arm 23, but their movement in the anterior-posterior directions is controlled by means of the fitting of the protrusions 61. Consequently, change of shape of the pressure contact blades 22 due to a pulling force being applied on the electric wire W can be further prevented from occurring, and the accuracy of dimension between the anterior and posterior pressure contact blades 22 can be improved.

The present invention is not limited to the embodiments described above. For example, the possibilities described below also lie within the technical range of the present invention.

(1) In the above embodiments, although an example was described where the invention is applied to a female terminal fitting F, the invention may equally be applied to a male terminal fitting.

(2) Although in the above embodiments the connecting arms 23, 42, and 54 are formed by bending the upper edge of the side wall 21, 41, and 51, it may equally be arranged so that these are formed by part-shearing part of the side wall, or that the anteriorly and posteriorly located pressure contact blades are not connected to the side walls but are connected by extending the upper edges of the pressure contact blades, or the like.

(3) Although in the second embodiment the pressure contact plates 43 are connected in a unified manner with anterior and posterior sides of the connecting arm 42, it may equally be arranged so that the pressure contact plates are part-sheared from the base plates, the pressure contact plates being connected by a connecting member bent from the upper edge of the side wall. In addition, the present invention may be embodied in various other ways without deviating from the scope thereof.

What is claimed is:

1. An electrical terminal fitting folded from sheet metal as a one-piece member, said fitting having upstanding side walls for receiving a wire therebetween along a longitudinal axis, and two pairs of mutually opposed blades positioned between said side walls, each pair of blades defining a contact groove therebetween on said axis to engage the wire, and each blade being spaced along said axis from an adjacent blade of the other pair of blades, wherein the adjacent blades on each side of said axis are connected by respective connecting members extending along said axis, a first of said connecting members is connected to and extends unitarily from one of said side walls, and two of said blades are connected to and extend unitarily from said first connecting member.

2. A fitting according to claim 1 wherein each of said side walls is connected to one of said connecting members, and each connecting member has two of said blades connected thereto.

3. A fitting according to claim 2 wherein said blades extend from opposite ends of said connecting members.

4. A fitting according to claim 1 wherein respective pairs of blades are connected to said first connecting member.

5. A fitting according to claim 4 wherein one of the blades of each of said pair of blades is connected to a second one of the connecting members.

6. A fitting according to claim 1 wherein two of said blades are integrally connected to one of said connecting members.

7. A fitting according to claim 1 wherein two of said blades are mechanically connected to one of the connecting members.

8. A fitting according to claim 7 wherein a protrusion of one of said blades and connecting member is engageable in an aperture of the other of said blades and connecting member.

9. A fitting according to claim 1 and further including mechanical connection means to engage one of said side walls of said terminal with said blades, said mechanical connection means comprising a respective protrusion of each of said blades engageable in an aperture of a respective one of said side walls.

10. A fitting according to claim 1 wherein the blades of each pair of mutually opposed blades are folded in opposite directions to form the contact groove.

* * * * *